US007520769B2

(12) United States Patent
Sakamoto et al.

(10) Patent No.: US 7,520,769 B2
(45) Date of Patent: Apr. 21, 2009

(54) CONNECTOR

(75) Inventors: Nobuyuki Sakamoto, Makinohara (JP); Keiko Ishida, Makinohara (JP); Kazuki Zaitsu, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/119,682

(22) Filed: May 13, 2008

(65) Prior Publication Data

US 2008/0286997 A1 Nov. 20, 2008

(30) Foreign Application Priority Data

May 16, 2007 (JP) ..... 2007-130119

(51) Int. Cl.
*H01R 13/15* (2006.01)

(52) U.S. Cl. ..... 439/260; 439/822

(58) Field of Classification Search ..... 439/259, 439/260, 822, 267

See application file for complete search history.

(56) References Cited

U.S. PATENT DOCUMENTS 4,445,732 A * 5/1984 Wafer ..... 439/822
4,555,604 A * 11/1985 Maier et al. ..... 439/822
6,979,216 B2 * 12/2005 Maeda et al. ..... 439/260

FOREIGN PATENT DOCUMENTS

JP 2001-155802 A 6/2001
JP 2003-007375 A 1/2003

* cited by examiner

*Primary Examiner*—Tho D Ta
(74) *Attorney, Agent, or Firm*—Sughrue Mion, PLLC

(57) ABSTRACT

A connector includes a first and a second terminal portions each having: a substrate pressing portion; a spacer pressing portion; and a fulcrum portion arranged between the substrate pressing portion and the spacer pressing portion, a spacer arranged between the spacer pressing portions of the first and the second terminal portions, and a clipping section formed of the substrate pressing portions of the first and the second terminal portions. The clipping section opens and closes while operating the fulcrum portions as a fulcrum. The spacer pressing portions of the first and the second terminal portions close via the fulcrum when the clipping section opens.

11 Claims, 4 Drawing Sheets

CONNECTOR

BACKGROUND

This invention relates to a connector and, in particular, to a type of a connector which establishes an electrical connection of electrodes thereto when a card-like substrate, on an end portion of which the electrodes are formed, is inserted into the connector.

There is a type of a connector (a socket) to establish an electrical connection when a card-like substrate, on one side of which a plurality of electrodes (circuit conductors) are provided, is inserted into the connector. The connector includes terminal clamps which connect the plurality of the electrodes to the substrate by clamping the substrate when the substrate is inserted. The terminal clamps have an elastic force, and holds the substrate by the elastic force, thereby maintaining the electrical connection.

Since the terminal clamp provided on the connector into which the substrate is inserted maintains the electrical connection with the electrode of the substrate by the elastic force of itself as described above, various arts are proposed to assure the electrical connection.

For example, FIG. 5 shows a substrate connecting structure according to a conventional art 1 disclosed in a Patent Document 1. In the conventional art 1, a terminal unit 70 includes a plurality of substrate connecting terminals 71 and a shaft member which supports the substrate connecting terminals 71 to arrange the substrate connecting terminals 71 in a predetermined manner. The shaft member is made of a circular insulating resin, and is held to be clipped by a bent portion of the substrate connecting terminal. In this way, clipping and connecting portion 72 to which a circuit conductor 77 of a circuit substrate connects is placed in a proper position.

FIG. 6 shows a structure of a card-edge connector 90 according to a conventional art 2 disclosed in a Patent Document 2. A terminal clip 80 of the card-edge connector 90 limits a movement of a circuit substrate 84 by a limiting unit 83 including an elastic connect piece 81 and a locking part 82 when the circuit substrate 84 is inserted into the card-edge connector 90.

[Patent Document 1] JP-A-2001-155802

[Patent Document 2] JP-A-2003-7375

Generally, a card-edge connector for receiving a substrate having two separate conductive connecting terminals with one on each sides of the substrate, requires more than merely the connecting terminals of a terminal clip to support the connecting weight and forces applied to the connector, when the substrate is inserted into the connector.

As a result, a housing is needed to receive a reactive force of the connecting terminal. Accordingly, if the housing if formed by a resin such as a plastic, the above reactive force acts continually, causing creep, or deformation of the housing, particularly in the presence of heat produced by the substrate. If creep occurs, the connecting force is reduced. Consequently, it may decrease a reliability of the connection.

In the conventional art 2, the connecting weight is received by the terminal alone. However, since the locking part 82 of the terminal clip 80 at the under side on the upper side of the substrate, there is a concern that the both sides conductor is short-circuited. Therefore, it is necessary to have a sufficient width between the terminals, and it is difficult to minimize the connector.

SUMMARY

In view of the above circumstances, an object of the invention is to solve the above problems. Specifically, the object is to avoid the creep phenomenon occurred to the housing when the substrate in which the conductor is formed on the both sides is inserted into the terminal clip.

In order to achieve the above-mentioned object, according to the present invention there is provided a connector, including:

a first and a second terminal portions each having:
- a substrate pressing portion;
- a spacer pressing portion; and
- a fulcrum portion arranged between the substrate pressing portion and the spacer pressing portion;

a spacer arranged between the spacer pressing portions of the first and the second terminal portions; and a clipping section formed of the substrate pressing portions of the first and the second terminal portions, and the clipping section opens and closes while operating the fulcrum portions as a fulcrum, and wherein the spacer pressing portions of the first and the second terminal portions close via the fulcrum when the clipping section opens.

Preferably, the first and the second terminal portions are separately formed; and wherein each of the fulcrum portions includes a fulcrum hole for inserting a pin serving as a common fulcrum.

Preferably, the first and the second terminal portions are electrically insulated from each other.

In order to achieve the above-mentioned object, according to the present invention there is also provided a connector, including:

a first and a second terminal portions each having:
- a substrate pressing portion;
- a compressive portion; and
- a fulcrum portion arranged between the substrate pressing portion and the compressive portion; and a clipping section formed of the substrate pressing portions of the first and the second terminal portions, and the clipping section opens and closes while operating the fulcrum portions as a fulcrum, wherein an opening operation of the clipping section generates forces acting on the compressive portions of the first and the second terminal portions in a closing direction of the compressive portions via the fulcrum so that the forces are canceled to each other.

According to the invention, when a predetermined member such as a substrate is inserted into a connector, both sides of the substrates are pressed down by a predetermined pressing force of two terminal portions which open and close around a supporting point, the reactive force of the pressing force is acted in a compression direction via the supporting point, and the force which acts in the compression direction is received by a predetermined spacer. Therefore, forces which expand the inside of a housing of the connector are not acted.

BRIEF DESCRIPTION OF THE DRAWINGS

The above objects and advantages of the present invention will become more apparent by describing in detail preferred exemplary embodiments thereof with reference to the accompanying drawings, wherein like reference numerals designate like or corresponding parts throughout the several views, and wherein.

DETAILED DESCRIPTION

Hereinafter, a preferred embodiment of the invention (hereinafter an embodiment) will be described with reference to the accompanying drawings.

Figure 1:
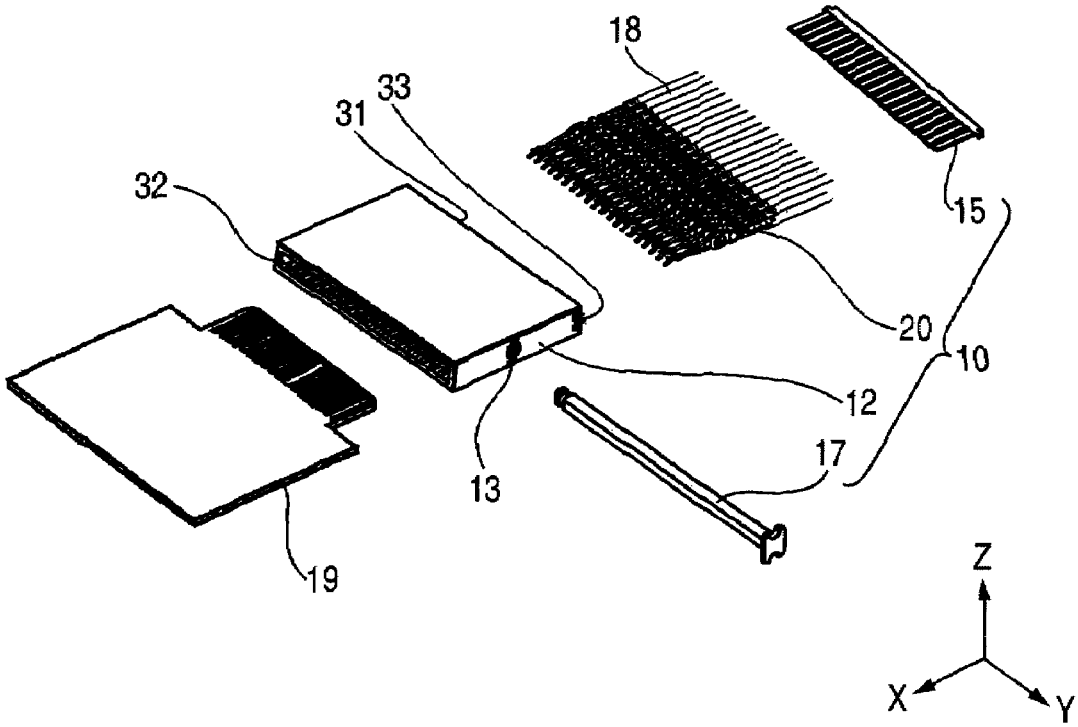
FIG. 1 is an exploded perspective view of a card-edge connector according to an embodiment of the invention.
Figure 2:
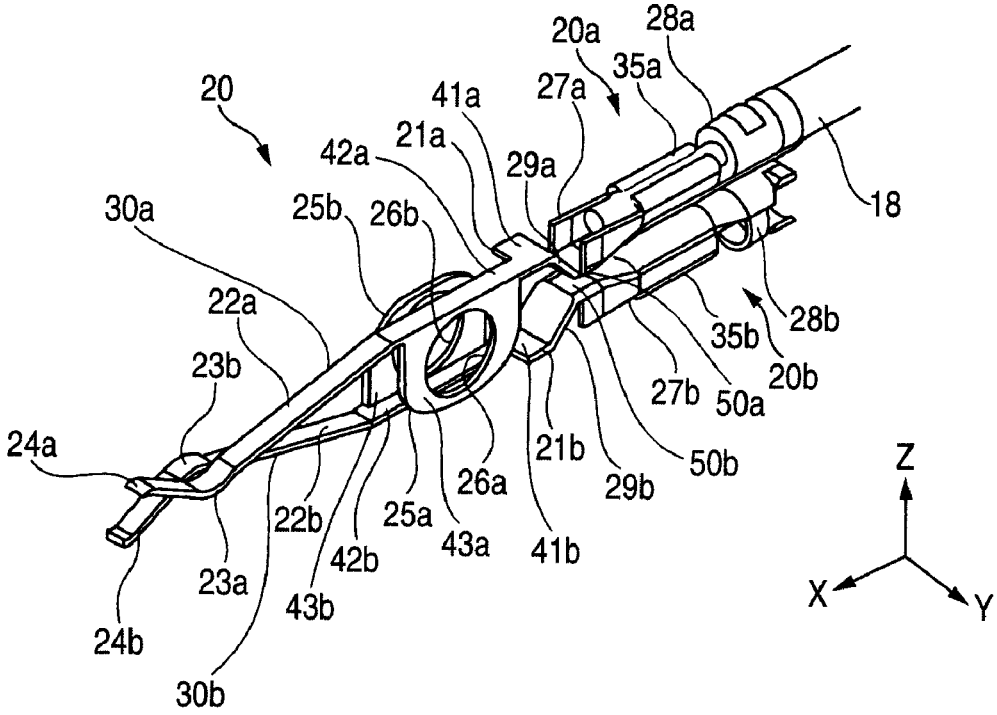
FIG. 2 is an perspective view of a terminal clamping portion of the card-edge connector according to the embodiment.
Figure 3:
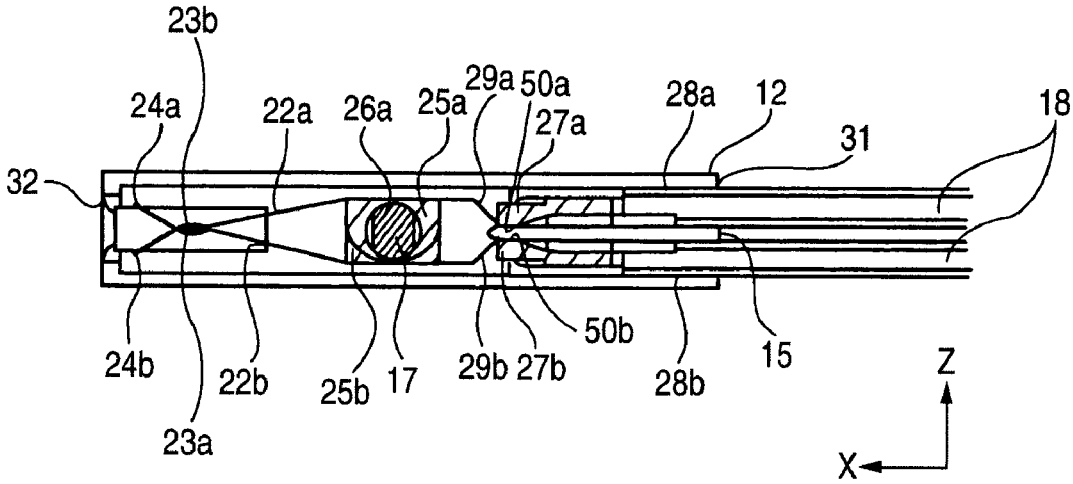
FIG. 3 is a schematic view of a cross section of the card-edge connector according to the embodiment.
Figure 4:
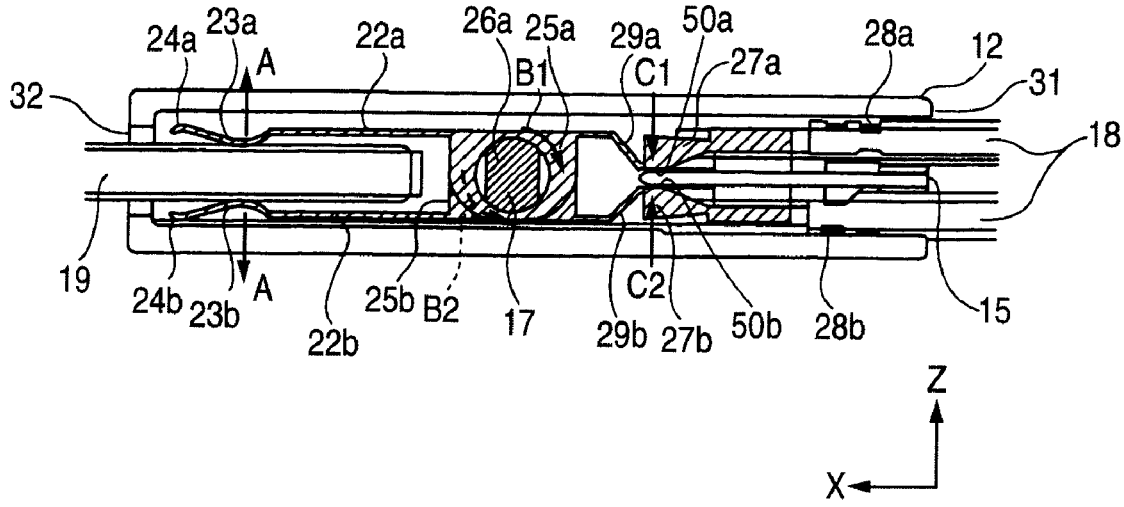
FIG. 4 is a schematic view of a cross section of the card-edge connector according to the embodiment, in particular, showing a state in which a substrate is inserted.
Figure 5:
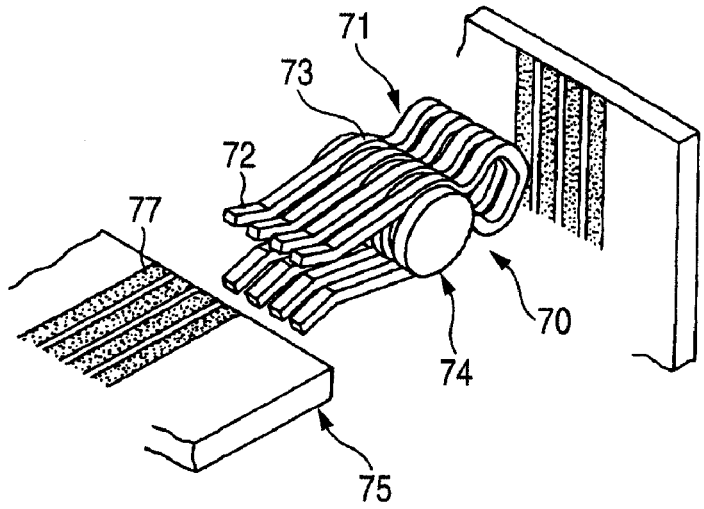
FIG. 5 shows a substrate connecting structure according to a conventional art 1.
Figure 6:
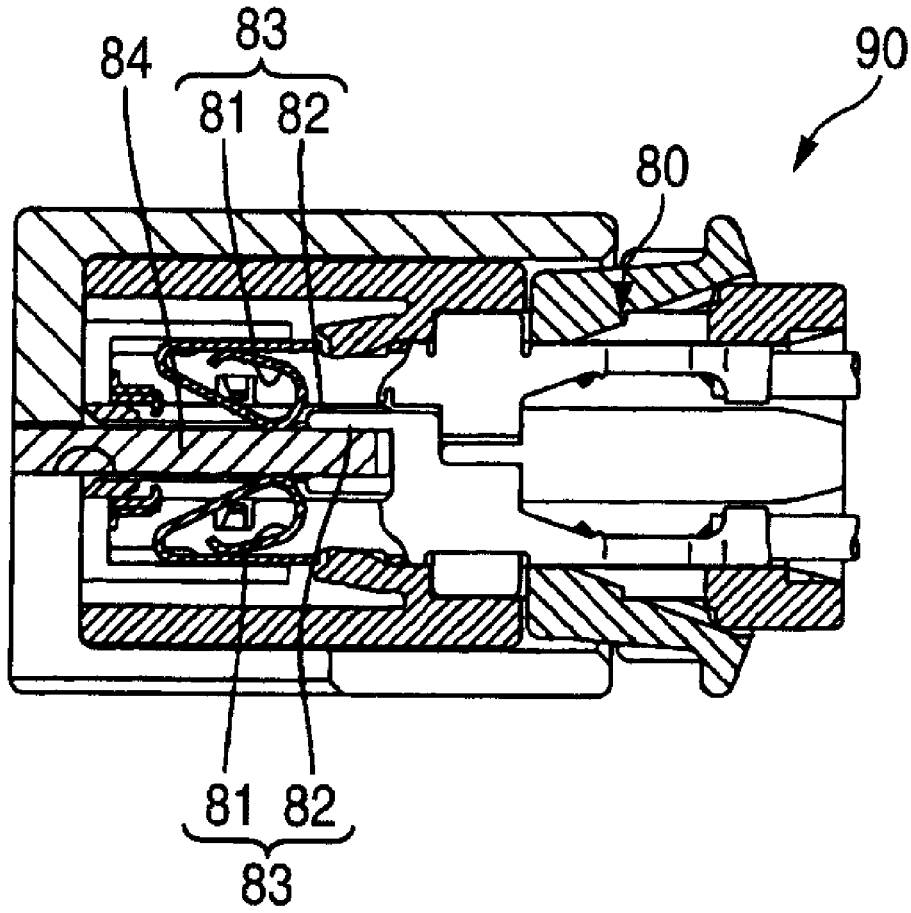
FIG. 6 shows a structure of a card-edge connector according to a conventional art 2.

FIG. 1 is an exploded perspective view of a card-edge connector 10 according to the embodiment, and also shows a substrate 19 which is inserted into the card-edge connector 10. FIG. 2 is an perspective view of a terminal clamping portion 20 which is a component of the card-edge connector 10. FIG. 3 is a schematic view of a cross section of the card-edge connector 10. FIG. 4 is a schematic view of a cross section of the card-edge connector 10 in a state in which a substrate is inserted.

As shown in FIG. 1, the card-edge connector 10 includes a resin housing 12, a plurality of terminal clamping portions 20, a comb-like spacer 15, and a pin 17. Here, wires 18 are connected to the terminal clamping portions 20.

The housing 12 includes a terminal insertion port 31 for incorporating the terminal clamping portions 20, a substrate insertion port 32 into which the substrate 19 is inserted, and a pin hole 13 into which the pin 17 is inserted.

As shown in FIG. 2, the terminal clamping portion 20 is incorporated into the housing 12 as a set with two terminals of a first terminal 20*a* and a second terminal 20*b*. In FIG. 1, twenty sets of the terminal clamping portions 20 are incorporated into the housing 12. The first terminal 20*a* and the second terminal 20*b* have an identical structure, and are integrally formed by press molding a conductive metallic plate with a high spring characteristic such as an aluminum alloy or a copper alloy. In this embodiment, the first terminal 20*a* and the second terminal 20*b* are symmetrically disposed in top and bottom.

The first terminal 20*a* includes a terminal body 21*a* and a clipping portion 30*a* with X-axis as a longitudinal direction. The terminal body 21*a* includes a fulcrum portion 25*a*, wire connection portion 28*a*, and contact portion 29*a*.

The fulcrum portion 25*a* includes a fulcrum rear edge 41*a*, a fulcrum supporting portion 42*a*, and a pin insertion portion 43*a*.

In the fulcrum portion 25*a*, the contact portion 29*a* is connected to an edge in a longitudinal direction (an edge in a minus direction of X-axis), and the clipping portion 30*a* is formed on the other edge (an edge in a plus direction of X-axis). At the fulcrum portion 25*a*, a part in which the contact portion 29*a* is formed is the fulcrum rear edge 41*a*. The fulcrum supporting portion 42*a* extends from the fulcrum rear edge 41*a* in a predetermined length in a horizontal direction (a plus direction of X-axis). Here, the fulcrum supporting portion 42*a* has such a configuration that a region in a minus direction of Y-axis is eliminated so as to the width of the fulcrum supporting portion 42*a* is less than half of the width of the fulcrum rear edge 41*a*.

The pin insertion portion 43*a* is formed in a substantially circular shape in a downward vertical direction (a minus direction of Z-axis) at a side edge of the fulcrum supporting portion 42*a*, that is, an edge in a non-longitudinal direction (an edge in a plus direction of Y-axis). A circular fulcrum hole 26*a* into which the pin 17 functioning as a fulcrum is inserted is formed on an substantial center of the pin insertion portion 43*a*.

The clipping portion 30*a*, the width of which is same as that of the fulcrum supporting portion 42*a*, is formed on an edge extending in a longitudinal direction (an edge in a plus direction of X-axis) of the fulcrum supporting portion 42*a*.

The clipping portion 30*a* includes a inclining portion 22*a*, contact pressing portion 23*a*, and a guide portion 24*a*.

Specifically, the inclining portion 22*a* is formed so as to extend from an edge of the fulcrum supporting portion 42*a* in a diagonally downward left direction (a plus direction of X-axis and a minus direction of Z-axis). An edge of the inclining portion 22*a* is about the same height as a center of the fulcrum hole 26*a*. The contact pressing portion 23*a* is formed on an edge of the inclining portion. Such a shape makes the clipping portion 30*a* have an elastic force in a up and down direction.

The contact pressing portion 23*a* is downcurved in a convex shape. A peak of the convex shape of the contact pressing portion 23*a* is a contact point with a circuit conductor provided on the substrate 19.

The guide portion 24*a* is formed on a left edge (an edge in a plus direction of X-axis) of the contact pressing portion 23*a*. The guide portion 24*a* is formed at a predetermined height toward a diagonally upward left. The predetermined height is set to be lower than the fulcrum supporting portion 42*a*.

On the other hand, the contact portion 29*a* extending toward a diagonally downward right direction is formed on an edge of the fulcrum portion 25*a* in a minus direction of X-axis, that is, on an edge of the fulcrum rear edge 41*a*, so as to be slightly higher than the center of the fulcrum hole 26*a* The wire connection portion 28*a* is formed on a right edge (an edge in a plus direction of X-axis) of the contact pressing portion 23*a*. The wire connection portion 28*a* includes a spacer pressing portion 27*a* and a press-contact portion 35*a*. A left edge of the spacer pressing portion 27*a* is connected to the contact portion 29*a*. The spacer pressing portion 27*a* is horizontally formed at a predetermined length, and extends slightly higher toward a diagonally upward right direction at a right side of the space pressing portion 27*a*. It is noted that a horizontally-formed face is called a pressing face 50*a*. The press-contact portion 35*a* to which an edge of the wire 18 is attached is formed on a right edge (an edge in a minus direction of X-axis) of the spacer pressing portion 27*a*. Ribs each having a predetermined height stand upwardly at both edges in a non-longitudinal direction (both edges in Y-axis direction) of the spacer pressing portion 27*a*, respectively. An upper ends of the ribs are slightly lower than the fulcrum supporting portion 42*a*.

The second terminal 20*b* has an identical structure as the first terminal 20*a* as described above, and a detailed description of the structure is omitted. The second terminal 20*b* includes a terminal body 21*b* and a clipping portion 30*b*. The terminal body 21*b* includes a fulcrum portion 25*b*, a wire connection portion 28*b*, and a contact portion 29*b*. The fulcrum portion 25*b* includes a fulcrum rear edge 41*b*, a fulcrum supporting portion 42*b*, and a pin insertion portion 43*b* on which a fulcrum hole 26*b* is formed. The clipping portion 30*b* includes a inclining portion 22*b*, a contact pressing portion 23*b*, and a guide portion 24*b*. The wire connection portion 28*b* includes a spacer pressing portion 27*b* having a pressing face 50*b*, and press-contact portion 35*b*.

The first terminal 20*a* and the second terminal 20*b* are arranged at a predetermined clearance so that the pressing face 50*a* of the spacer pressing portion 27*a* is opposed to the pressing face 50*b* of the spacer pressing portion 27*b*. The spacer 15 having about the same thickness as the clearance is inserted between the pressing faces 50*a*, 50*b*, thereby both edges of the spacer 15 are engaged to a spacer engaging portion 33 shown in FIG. 1. Since each width of the fulcrum supporting portions 42*a*, 42*b* is less than half of each width of the fulcrum rear edge 41*a*, 41*b* as described above, the clipping portions 30*a*, 30*b* extending at the same width from the fulcrum supporting portions 42*a*, 42*b* do not contact with each other.

Next, a description is made on a condition where a set of the terminal clamping portion 20 is inserted into the housing 12 with reference to a schematic view of a cross section of the card-edge connector 10 as shown in FIG. 3. In FIG. 3, the first terminal 20*a* and the second terminal 20*b* shown in FIG. 2 are inserted from the terminal insertion port 31 to be incorporated in the housing 12 so that the guide portions 24*a*, 24*b* are located adjacent to the substrate insertion port 32.

One common pin 17 is inserted into the fulcrum hole 26*a* of the first terminal 20*a* and the fulcrum hole 26*b* of the second terminal 20*b*. The pin 17 is formed of an insulating material such as a resin. A part of cylindrical portion of the pin 17 is eliminated along the longitudinal direction in terms of the facility of insertion. Specifically, both sides (right and left sides) of the pin 17 are vertically eliminated in cross sectional view as shown in FIG. 3, and two flat faces are symmetrically formed along the longitudinal direction in the pin 17 as shown in FIG. 1. More specifically, in cross sectional view as shown in FIG. 3, assume Z-axis as a reference of central angle, portions where the central angle of the pin 17 ranges from 315 to 45 degree and from 135 to 225 degree are arc-shape (curved face), and portions where the central angle of the pin 17 ranges from 45 to 135 degree and from 225 to 315 degree are straight-line (flat face).

Both edges of the pin 17 are engaged to the pin insertion hole 13 and fixed when the pin 17 is inserted with a predetermined portion from the pin insertion hole 13. When the pin 17 is fixed, the pin 17 is inserted through the fulcrum holes 26*a* of the first terminals 20*a* and the fulcrum holes 26*b* of the second terminals 20*b* included in a plural set of the terminal clamping portion 20 incorporated in the housing 12. In this way, the movement of the first terminals 20*a* and the second terminals 20*b* is restricted in a horizontal direction (X-axis direction) in FIG. 3.

As to the guide portion 24*a* of the first terminal 20*a* and the guide portion 24*b* of the second terminal 20*b*, the edges thereof are arranged adjacent to the inside of the substrate insertion port 32 of the housing 12, and extend toward an expanding direction from a center in a vertical direction (Z-axis direction), respectively.

The two spacer pressing portions 27*a*, 27*b* are arranged at a right side of the center in FIG. 3, and the spacer 15 is inserted between the two opposing pressing faces 50*a* and 50*b*.

Next, when the substrate 19 is inserted into the housing 12, a state of the constituent elements of the first terminal 20*a* and the second terminal 20*b* and acting force will be described with reference to FIG. 4.

When the substrate 19 is inserted through the substrate insertion port 32, the substrate 19 is guided by the two guide portions 24*a*, 24*b* so as to move rightward. As the substrate 19 moves rightward, the two contact pressing portions 23*a*, 23*b* move upward and downward (A direction in the figure) and away from each other. At this time, a pressing force (a contact weight) acts on the contact pressing portions 23*a*, 23*b* by an elastic force on the clipping portions 30*a*, 30*b*.

At the same time, a reactive force of the above-described contact weight is acted on the clipping portions 30*a*, 30*b* with the pin 17 as a fulcrum. Therefore, a rotating force is occurred to the fulcrum portion 25*a* of the first terminal 20*a* in a clockwise direction (B1 direction in the figure) with the pin 17 as a fulcrum, and a rotating force is occurred to the fulcrum portion 25*b* of the second terminal 20*b* in a counterclockwise direction (B2 direction in the figure) with the pin 17 as a fulcrum.

As a consequence, a moving force in a downward direction (C1 direction in the figure) is acted on the spacer pressing portion 27*a* of the first terminal 20*a*, and a moving force in a upward direction (C2 direction in the figure) is acted on the spacer pressing portion 27*b* of the second terminal 20*b*.

At this time, movement of the two spacer pressing portions 27*a*, 27*b* is restricted by the spacer 15 since the spacer 15 is arranged between the two spacer pressing portions 27*a*, 27*b*. Consequently, a force in a compressive direction (C1 and C2 directions in the figure) is applied to the spacer 15 by the pressing face 50*a* of the spacer pressing portion 27*a* and the pressing face 50*b* of the spacer pressing portion 27*b*. At this time, the force acting on the spacer 15 from the pressing face 50*a* of the first terminal 20*a* and the force acting on the spacer 15 from the pressing face 50*b* of the second terminal 20*b* have the same amplitude. Therefore, the two forces cancel each other, and the spacer 15 does not move upward and downward.

That is, when the substrate 19 is inserted through the substrate insertion port 32, although a force is exerted on the pin 17 in a shearing direction and a compressive force is exerted on the spacer 15 no broadening force is exerted on the inside of the housing 12.

In other words, the spacer 15 receives two contact weight forces generated by broadening the clipping positions 30*a*, 30*b* of the terminal clamping portion 20 through the fulcrum which cancel each other. Therefore, the force causing broadening or deformation of the housing 12 does not occur, and the occurrence of creep is evaded. Further, since the strength of the housing 12 can be lowered, a size and weight reduction in the housing 12 in can be realized.

The present invention has been described with reference to the embodiment as stated above. However, this embodiment is an example. What various changes and modifications to the combination of the constituent elements can be done and what such changes and modifications are deemed to come within the scope of the present invention would be apparent to those skilled in the art.

For example, the spacer 15 may be removed if it is unnecessary to insulate the first terminal 20*a* from the second terminal 20*b*. In this case, since the two spacer pressing portions 27*a*, 27*b* receive mutual forces, the intensity of the housing 12 may be as in view of the acting force. Further, although the force by the pressing faces 50*a*, 50*b* acts on the spacer 15 on a face, the force may act on a point or on a line. Further, the spacer pressing portions 27*a*, 27*b* may directly extend from the fulcrum portions 25*a*, 25*b* without the contact portions 29*a*, 29*b*.

This invention can be applied to industrial products such as computers, an electronic device and an automobile where the products and parts performing an electrical connection by inserting a substrate including a conductor at the edge thereof are used.

What is claimed is:

1. A connector, comprising:

a housing;

a first and a second terminal portion disposed in the housing each having:

a substrate pressing portion;

a spacer pressing portion; and a fulcrum portion arranged between the substrate pressing portion and the spacer pressing portion;

a first and second wire respectively coupled to the first and second terminal portions;

a spacer arranged between the spacer pressing portions of the first and the second terminal portions; and a clipping section defined by the substrate pressing portions of the first and the second terminal portions, the clipping section opening and closing while operating the fulcrum portions as a fulcrum for clipping a substrate in the clipping section, and wherein insertion of the substrate into the clipping section of the substrate pressing portion generates substantially equal and opposite respective forces on the spacer pressing portions of the first and the second terminal portions.

2. The connector as claimed in claim 1, wherein the first and the second terminal portions are electrically insulated from each other.

3. The connector as claimed in claim 1, wherein the fulcrum portions of the first and second terminal portions are aligned with one another in a direction transverse to a direction of the terminal portions.

4. The connector as claimed in claim 1, wherein the first and the second terminal portions are separately formed; and wherein each of the fulcrum portions includes a fulcrum hole for inserting a pin serving as a common fulcrum.

5. The connector as claimed in claim 4, wherein a plurality of the first and second terminal portions are aligned with one another in a direction transverse to a longitudinal direction of the terminal portions, and wherein the pin is inserted into all of the fulcrum holes of the terminal portions to serve as common fulcrum.

6. A connector, comprising:

a housing;

a first and a second terminal portions disposed in the housing each having:

a substrate pressing portion;

a press contact portion for attaching a wire to each of the terminal portions;

a compressive portion; and a fulcrum portion arranged between the substrate pressing portion and the compressive portion; and a clipping section defined by the substrate pressing portions of the first and the second terminal portions, the clipping section opening and closing while operating the fulcrum portions as a fulcrum for clipping a substrate in the clipping section, wherein an opening operation of the clipping section generates forces acting on the compressive portions of the first and the second terminal portions in a closing direction of the compressive portions via the fulcrum so that the forces cancel each other.

7. The connector as claimed in claim 6, wherein the first and second terminal portions are conductive.

8. The connector as claimed in claim 6, wherein the substrate pressing portion of the first and second terminal portions each include an inclining portion interconnecting the clipping portion and the fulcrum portion.

9. The connector as claimed in claim 8, wherein the inclining portions are flexible.

10. The connector as claimed in claim 6, wherein each of the fulcrum portions includes a fulcrum hole for inserting a pin serving as a common fulcrum.

11. The connector as claimed in claim 10, wherein a plurality of the first and second terminal portions are aligned with one another in a direction transverse to a longitudinal direction of the terminal portions, and wherein the pin is inserted into all of the fulcrum holes of the terminal portions to serve as common fulcrum.

* * * * *